US009159307B1

(12) United States Patent
Ludovici

(10) Patent No.: US 9,159,307 B1
(45) Date of Patent: Oct. 13, 2015

(54) MIDI CONTROLLER KEYBOARD, SYSTEM, AND METHOD OF USING THE SAME

(71) Applicant: Louis N. Ludovici, Plymouth, MA (US)

(72) Inventor: Louis N. Ludovici, Plymouth, MA (US)

( * ) Notice: Subject to any disclaimer, the term of this patent is extended or adjusted under 35 U.S.C. 154(b) by 54 days.

(21) Appl. No.: 14/209,969

(22) Filed: Mar. 13, 2014

(51) Int. Cl.
*G10H 1/32* (2006.01)
*G10H 3/00* (2006.01)
*G10H 1/00* (2006.01)

(52) U.S. Cl.
CPC ..... *G10H 1/0066* (2013.01)

(58) Field of Classification Search
CPC . G10H 2240/056; G10H 1/0066; G10H 1/34; G10H 1/0041; G10H 2240/311; G10H 2240/175; G10H 1/344; G10H 2220/231; G10H 2210/081; G10H 2220/096; G10H 2220/295; G10H 1/32; G10H 2220/026; G10H 2220/221; G10H 2220/241; G10H 2230/011
See application file for complete search history.

(56) References Cited

U.S. PATENT DOCUMENTS

| | | | | |
|---|---|---|---|---|
| 4,031,800 | A | 6/1977 | Thompson | |
| 4,528,428 | A | 7/1985 | Gotoh et al. | |
| 5,440,071 | A * | 8/1995 | Johnson | 84/637 |
| 5,741,990 | A * | 4/1998 | Davies | 84/423 R |
| 5,841,052 | A * | 11/1998 | Stanton | 84/600 |
| 6,093,879 | A | 7/2000 | Pye | |
| 7,342,164 | B2 * | 3/2008 | Nishibori et al. | 84/464 R |
| 7,361,826 | B2 | 4/2008 | Brun | |
| 7,394,010 | B2 * | 7/2008 | Nishibori et al. | 84/464 A |
| 7,667,119 | B1 | 2/2010 | Schlapkohl | |
| 7,709,724 | B2 * | 5/2010 | Nishibori et al. | 84/614 |
| 8,173,884 | B2 | 5/2012 | Gatzsche et al. | |
| 2002/0134223 | A1 * | 9/2002 | Wesley | 84/719 |
| 2003/0209130 | A1 * | 11/2003 | Anderson et al. | 84/443 |
| 2005/0126372 | A1 * | 6/2005 | Ludwig | 84/645 |
| 2005/0126378 | A1 * | 6/2005 | Ludwig | 84/746 |
| 2006/0005693 | A1 * | 1/2006 | Nishibori et al. | 84/723 |
| 2006/0123982 | A1 * | 6/2006 | Christensen | 84/723 |
| 2006/0236846 | A1 * | 10/2006 | Nishibori | 84/603 |
| 2008/0173163 | A1 * | 7/2008 | Pratt | 84/645 |
| 2009/0114078 | A1 * | 5/2009 | Plamondon | 84/423 R |
| 2011/0100198 | A1 * | 5/2011 | Gatzsche et al. | 84/615 |
| 2014/0076126 | A1 * | 3/2014 | Terry | 84/609 |
| 2014/0196592 | A1 * | 7/2014 | Bergman | 84/613 |

FOREIGN PATENT DOCUMENTS

| | | |
|---|---|---|
| EP | 0201294 | 7/1991 |
| EP | 0313579 | 11/1993 |
| EP | 1282111 | 2/2003 |

* cited by examiner

*Primary Examiner* — Marlon Fletcher
(74) *Attorney, Agent, or Firm* — Jerry K. Joseph; Pitts & Lake, P.C.

(57) ABSTRACT

A musical instrument including a housing, a keypad having a plurality of push buttons arranged in a three-dimensional array of horizontal rows and vertical columns disposed within the housing and a CPU with MIDI and USB processing coupled to the keypad to manipulate and control a sound generated with signals from the plurality of push buttons, wherein the horizontal rows of push buttons are arranged in tiers.

14 Claims, 15 Drawing Sheets

MIDI CONTROLLER KEYBOARD, SYSTEM, AND METHOD OF USING THE SAME

BACKGROUND

1. Field of the Invention

The present general inventive concept relates generally to electronic musical instruments and more particularly to electronic musical instruments operating within the musical instrument digital interface ("MIDI") protocol which incorporate at least one keyboard having push buttons arranged in a three-dimensional array. Additionally, the present general inventive concept relates to computer software to help users learn to play the musical instrument according to the present general inventive concept.

2. Description of the Invention

Conventional keyboards for piano, accordion, organ and other musical instruments are made having an interface with discrete divisions capable of being individually actuated by human fingers. A standard piano keyboard has a generally linear arrangement with the tones arranged in a chromatic musical scale ascending from left to right.

This arrangement is similar on a piano accordion, with the keyboard tilted vertically and played with a user's right hand only. On the piano accordion, the user's left hand plays push buttons that are in a two dimensional array rather than in a simple linear arrangement. On other accordions, the linear, piano keyboard is abandoned altogether and there is a two dimensional arrangement of push buttons for either hand to play.

A compact, equal interval keyboard of the present general inventive concept offers considerable improvement over conventional keyboards. It is remarkably compact in that all of the notes of the chromatic scale are presented to the player on push buttons in an exceptionally efficient arrangement. The spacing is similar to that in a computer keyboard, except that all of the push buttons are arranged in straight columns as well as straight rows, that is, in a checkerboard pattern. It is like the nine equally sized and equally spaced push buttons of the numeral entry keypad that the larger computer keyboards have, expanded to cover the whole keyboard area.

On this keyboard, a typical adult's hand can comfortably span three octaves. On a standard piano, a comfortable span is only one octave, and even on a reduced size keyboard of a piano accordion, the span is only about an octave and a half.

The tonal relationship of the push buttons on this keyboard offers an important opportunity to develop advanced musical instruments. From left to right, the push buttons are arranged in an ascending chromatic scale. Going from row to row, out from the player's body, each push button is a musical perfect fourth above the preceding push button. This is similar to the tonal arrangement on a bass guitar, if the guitar were flat on a table in front of the player, with the tuning pegs to the left and the body of the guitar to the right.

To play this keyboard, the five fingers of the hand naturally rest upon five adjacent push buttons in a row. They are positioned to play the first five notes of a chromatic scale. If, for instance, the user's thumb of the right hand were on "C," then the index finger would be on "C#," the middle finger on "D," the ring finger on "D#" and the pinky on "E." The next note to be played in the chromatic progression is "F," but with the this keyboard it is unnecessary to move one's hand sideways out of position in order to play "F." The arrangement of push buttons allows the thumb to play "F" simply by lifting the thumb off of the "C" push button and moving it straight up to the "F" push button in the next row, and so on.

Thus, in this geometric arrangement, most of the movement of the player's hands is directly out and back from the front of his body, rather than laterally as in a conventional piano keyboard. With a keyboard more than five columns wide, the user's hand is still free to move laterally, which is particularly advantageous in playing chords and changing keys. However, in most melody playing situations, the hand settles into a very simple pattern where each finger need only play the notes in its one column. There is very little crossing-over of fingers, jumping about or reaching to be concerned with. The task of planning how to finger complicated runs of notes is practically eliminated.

The symmetrical, equal interval pattern of the push buttons on this keyboard affords an advancement not achieved in virtually any other musical instrument. In moving from one note to another, the physical relationship between the two notes always exactly matches the musical relationship.

All of the musical relationships between any two notes on the chromatic scale have been given a label. For instance, the musical relationship between "C" and "E" is called a major third. It is played on the piano with the two white notes "C" and "E". If one were to maintain the same spanned distance with two fingers on a hand and move up the keyboard to the next white notes, one would be playing "D" and "F". This is not a major third, but a minor third. There is one less half-step between "D" and "F" than there is between "C" and "E." If one would want to maintain the same musical interval while moving the lower finger from "C" to "D," the upper finger would have to move from "E" to "F#", not only a change in span between the two fingers, but also a change in direction. Similar unsymmetrical arrangements on many other conventional musical instruments make playing music unnecessarily complex.

On this keyboard, for any musical interval one may choose, the two notes in the interval, beginning on any note of the chromatic scale, are always exactly the same physical distance apart for that interval and in the same direction. Basically, what one hears musically is matched by what physical movements the user is required to make in order to play.

Once one learns how to play a musical interval, it does not change. There is no need to learn other physical arrangements if one starts from different notes. One result of this is if one learns a song in one key, one can play it in any other key with exactly the same fingering by merely shifting the hand to start on a different note. There is no need to learn different fingering directions and distances for each key.

The second result is that specified chords are fingered exactly the same way in any key, that is, a "C" major chord is fingered exactly the same as an "F#" major chord. One merely shifts the hand and starts it on a different note.

Once a musician acquaints himself with the pattern of notes on this keyboard, playing a musical piece is almost as easy as singing a melody that one hears in one's head. Improvization is simplified.

An important requirement to have a viable professional musical instrument based upon this keyboard is to have a separable keyboard for each hand. In trying to position the hands to play on a single keyboard of this form, not only do the hands interfere with one another but neither hand is ergonomically situated relative to the keyboard for ease of play.

Although the keyboard proposed in the present inventive concept could be incorporated into non-MIDI enabled musical instruments, the addition of elements from the MIDI protocol immensely expands the capabilities of the keyboard and provides opportunity for an interactive computer tutorial that greatly simplifies the learning of music on the keyboard.

Therefore, it would be desirable to provide a MIDI controller in the form of compact, equal interval musical keyboards which optimize the capabilities of the musical instrument by allowing musicians to use both hands and all fingers, unencumbered.

BRIEF SUMMARY OF THE INVENTION

An aspect and/or utility of the present general inventive concept is to provide MIDI controllers in the form of compact musical keyboards having three dimensional arrays of push buttons that optimize the playing comfort of both hands as well as the use of the thumb in the playing of notes.

Of great importance with this keyboard, to have it function as a viable profession instrument, is to set the push button rows in tiers. The thumb, since it strikes a push button on its side, is unable to arch over other push buttons that are in line with the intended push button. Therefore, if all of the push buttons were set in a flat plane, the thumb would tend to inadvertently press other push buttons along its path unless the hand is held in an uncomfortable, ergonomically inefficient position. One reason the black notes are raised above the white notes on a piano is to give this clearance to the thumb for ease of playing.

The musical instrument includes setting the rows of the keyboard in tiers. The rise of one tier above another may equal the distance the push button travels when activated by a finger.

Another aspect and/or utility of the present general inventive concept provides a user with a tutorial arrangement in the form of computer software that facilitates musical instruction.

Another aspect and/or utility of the present general inventive concept provides musical keyboards having novel capabilities and a professional quality while still being easy to learn and play.

Another aspect and/or utility of the present general inventive concept provides musical keyboards that can be produced inexpensively, so that they can be the basis of toys and games as well as being incorporated into affordable professional instruments.

The present general inventive concept includes a MIDI controller keyboard. The MIDI controller keyboard includes separable portions for each hand, and setting the rows of push buttons in tiers. In exemplary embodiments, the push buttons may be contoured and/or curved to correspond to a user's fingers. In further exemplary embodiments, the MIDI controller keyboard includes an integrated expression roller controlled by wrist action which may be used to change a quality of a generated tone.

The present general inventive concept includes a chromatic scale which may be extended in columns and rows. As a result, a range of the instrument according to the present general inventive concept is extended.

Another aspect and/or utility of the present general inventive concept provides a musical instrument including a housing, a keypad, electronics disposed within the housing for the decoding of the key array, and various auxiliary controls, polyphonic, multi-timbre tone generation and amplification to sound through an integrated speaker system as well as MIDI and USB encoding.

The musical instrument further includes conventional double contact push buttons to generate two distinguishable signals, one at either end of the push button travel. For instance, a first signal when a push button is first pressed and a second signal when the push button arrives at its end position.

The electronics may determine a velocity value based on a calculated time between receiving the first signal and the second signal.

The velocity value may control a degree of loudness of the produced sound.

The musical instrument further includes a plurality of overall sensors mechanically disposed between the plurality of push buttons as a whole and the instrument frame.

The electronics may sum and convert all received push button signals into an after-touch signal.

The after touch signal may control various qualities of the sound produced by the plurality of push buttons.

BRIEF DESCRIPTION OF THE DRAWINGS

These and other features, aspects and utilities of the present general inventive concept will become better understood with reference to the following description, appended claims and accompanying drawings where:

DETAILED DESCRIPTION OF THE PREFERRED EMBODIMENTS

Figure 1:
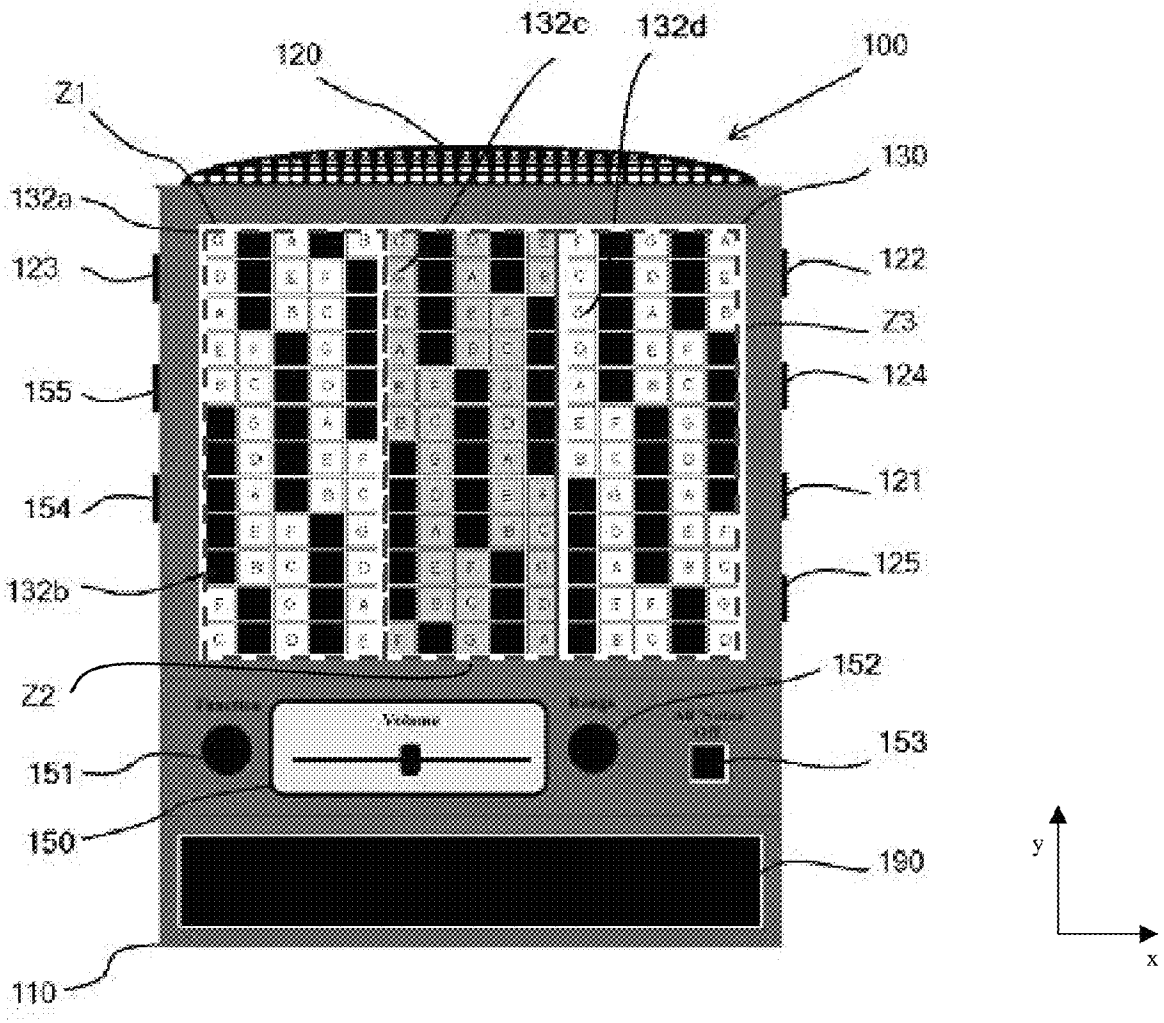
FIG. 1 is a top plan schematic view of a MIDI controller keyboard according to an exemplary embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

The present general inventive concept relates to a musical instrument, wherein the push buttons are arranged in tiers such that a user's thumb as well as the other fingers can easily play all push buttons without inadvertently activating adjacent push buttons.

The term "chromatic scale" refers herein to a musical scale with twelve pitches, each one a semi-tone above or below another. On typical pianos or other equal-tempered musical instruments, all of the semi-tones are the same size (i.e., 100 cents). Thus, notes of an equal tempered chromatic scale are equally spaced.

The term "polyphony" refers herein to a sound consisting of two or more simultaneous lines of independent melody, as opposed to "monophony" which refers to a sound having a single voice or "homophony" which refers to a sound having a single dominant voice accompanied with chords. That is, polyphony refers to a sound consisting of two or more simultaneous lines of independent melody. The present general inventive concept allows for polyphony, wherein more than one note may be played at the same time.

The term "keyboard expression" refers herein to an ability of a musical keyboard or other musical instrument to respond to characteristics of music or change the tone of the sound in response to the manner in which the user depresses the push buttons of the musical keyboard. Keyboard expressions include "velocity" which refers to how fast the push buttons are pressed, "after-touch" which refers to an amount of force is applied to a held-down push button, and "push button displacement" which refers to a distance that a push button is pressed down.

Referring to FIGS. 1 through 9, the MIDI controller keyboard 100 includes a housing 110, a keypad 130, a plurality of auxiliary controls, inputs and outputs and CPU based electronics. The MIDI controller keyboard 100 functions as a musical instrument that operates within the musical instrument digital interface ("MIDI") protocol.

Figure 2:
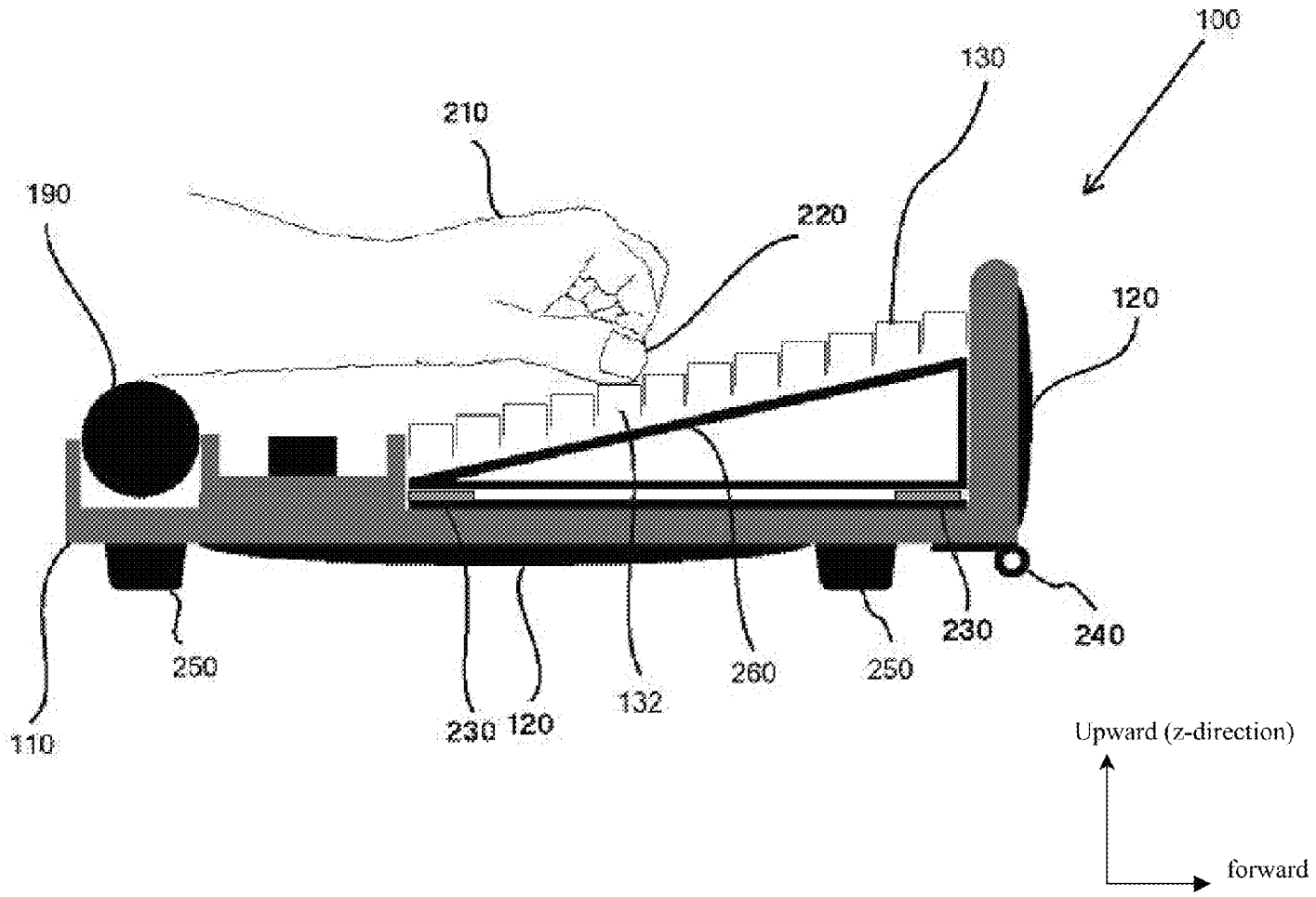
FIG. 2 is a side cross-sectional schematic view of the MIDI controller keyboard illustrated in FIG. 1.

The housing 110 may be formed in a substantially rectangular shape as seen in the plan of the top panel in FIG. 1, and with a slanted shape when viewed from the side as in the cross sectional view of FIG. 2. There is sufficient space within the enclosure/keypad substrate 260 for all of the electronics necessary for the MIDI controller keyboard 100.

Figure 4:
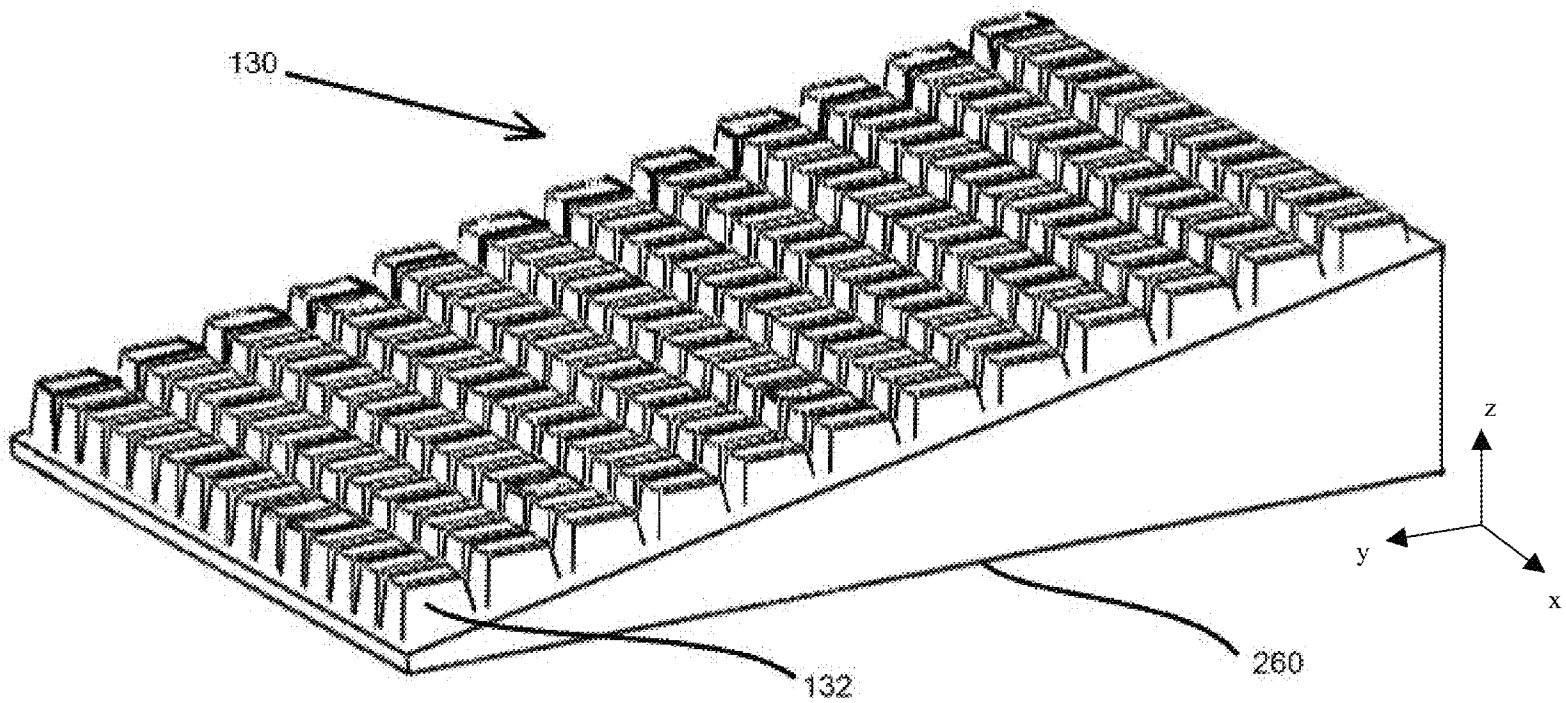
FIG. 4 is a front perspective schematic view of the keypad illustrated in FIG. 1.

In the present exemplary embodiment, the keypad 130 includes a plurality of push buttons 132 arranged in a three-dimensional array, exemplified in FIG. 4. That is, referring to FIGS. 1 and 4, the plurality of push buttons 132 are arranged in rows along the x-direction, columns along the y-direction, and tiers along the z-direction. The plurality of push buttons 132 are disposed in a series of horizontal rows and vertical columns, wherein the rows and columns are substantially perpendicular to each other. In a preferred embodiment, the three-dimensional array consists of twelve horizontal rows of push buttons 132 and fifteen vertical columns of push buttons 132. The center-to-center distance of adjacent push buttons 132 in both the horizontal and vertical axis of the two-dimensional array may be about ¾ inch. However, the present general inventive concept is not limited thereto.

Figure 7:
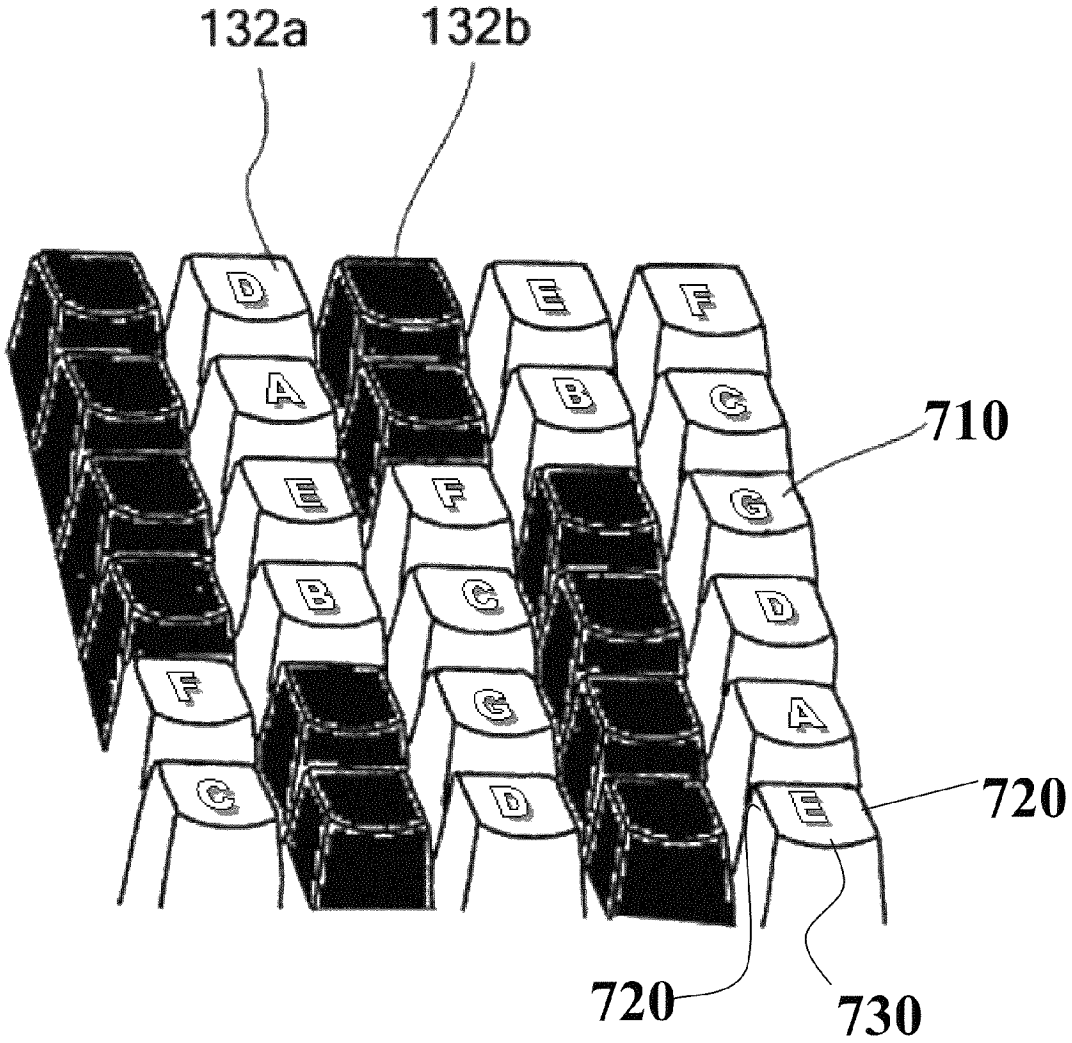
FIG. 7 is a front perspective schematic enlarged view illustrating a portion of the keyboard having lettering printed, molded-in, or inlayed according to an exemplary embodiment of the present general inventive concept.

FIG. 7, is a top perspective view of a section of a keypad 130 illustrating lettering of notes. The plurality of push buttons 132 include a plurality of white push buttons 132*a* and a plurality of black push buttons 132*b*. In exemplary embodiments, as an aid in orientation to the conventional chromatic scale depicted on conventional keyboards, the white push buttons 132*a* correspond to the white notes of a piano and the black push buttons 132*b* correspond to the black notes of a piano. In addition, the musical note letter 710 corresponding to each push button 132*a* may be printed, molded-in, or inlayed on the top surface of the push buttons 132.

Figure 8:
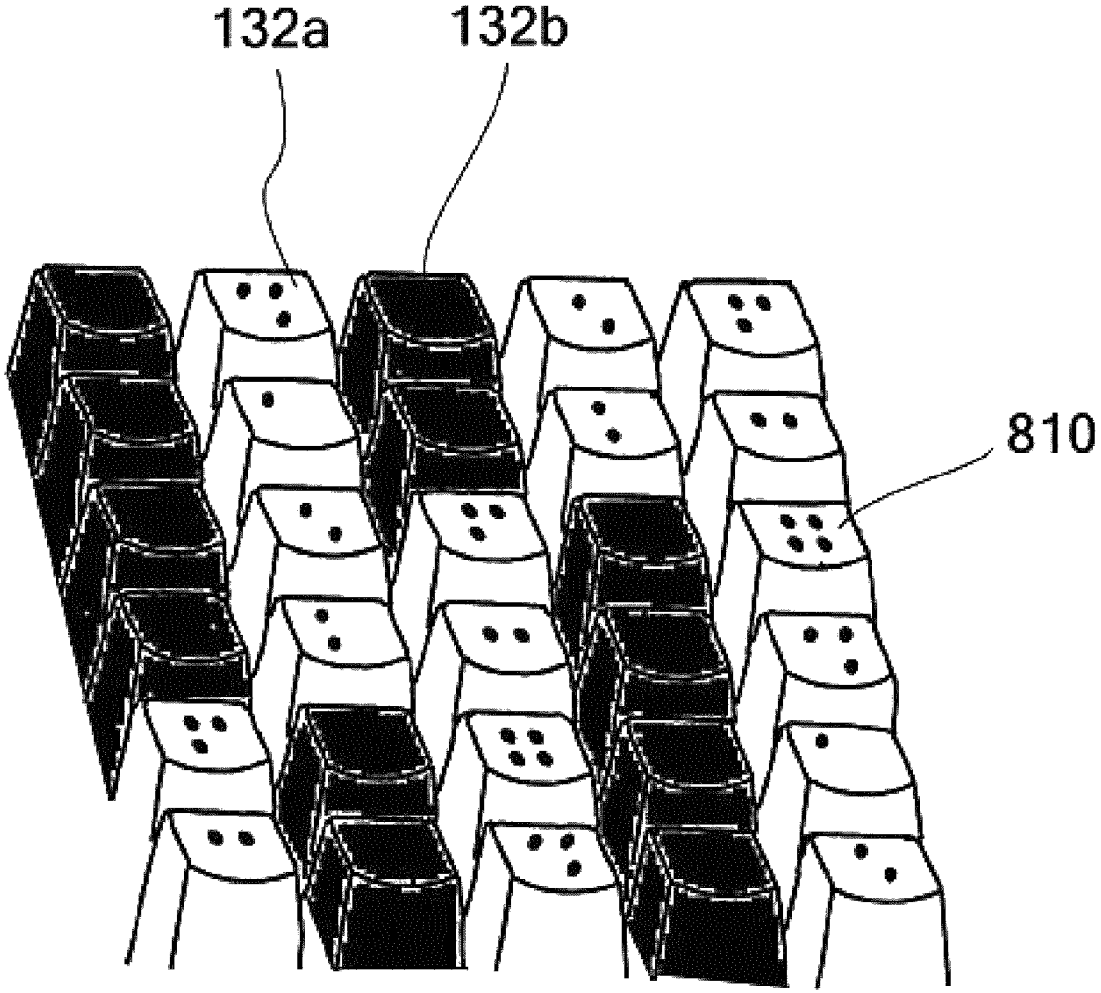
FIG. 8 is a front perspective schematic enlarged view illustrating a portion of the keyboard having braille according to an additional exemplary embodiment of the present general inventive concept.

FIG. 8 is a top perspective view of a section of a keypad 130 according to another exemplary embodiment of the present general inventive concept. The present exemplary embodiment provides a system which may function as an aid to users who require or otherwise desire assistance with orientation, and thereby control of the MIDI controller keyboard 100. For instance, in addition to note letters on the push buttons 132, the present exemplary embodiment further includes raised braille dots on the push buttons 132 which represent the note of the push button 132.

The keypad 130 is configured to produce an overall range of nearly 6 octaves. However, in an alternative exemplary embodiment, two keyboards 100 may be coupled together electronically to produce a greater musical range. For a professional instrument it is essential that there be a keyboard 100 for each hand, not only to equal the musical range of a concert piano, but to provide the most ergonomic playing position for each hand. The chromatic scale may be extended in the rows and columns of the push buttons 132 by shifting the keyboard as a whole by octaves. This substantially extends the range of the MIDI controller keyboard 100, for instance, by making the left hand keyboard a "bass" keyboard and the right hand keyboard a "treble" keyboard.

Figure 9:
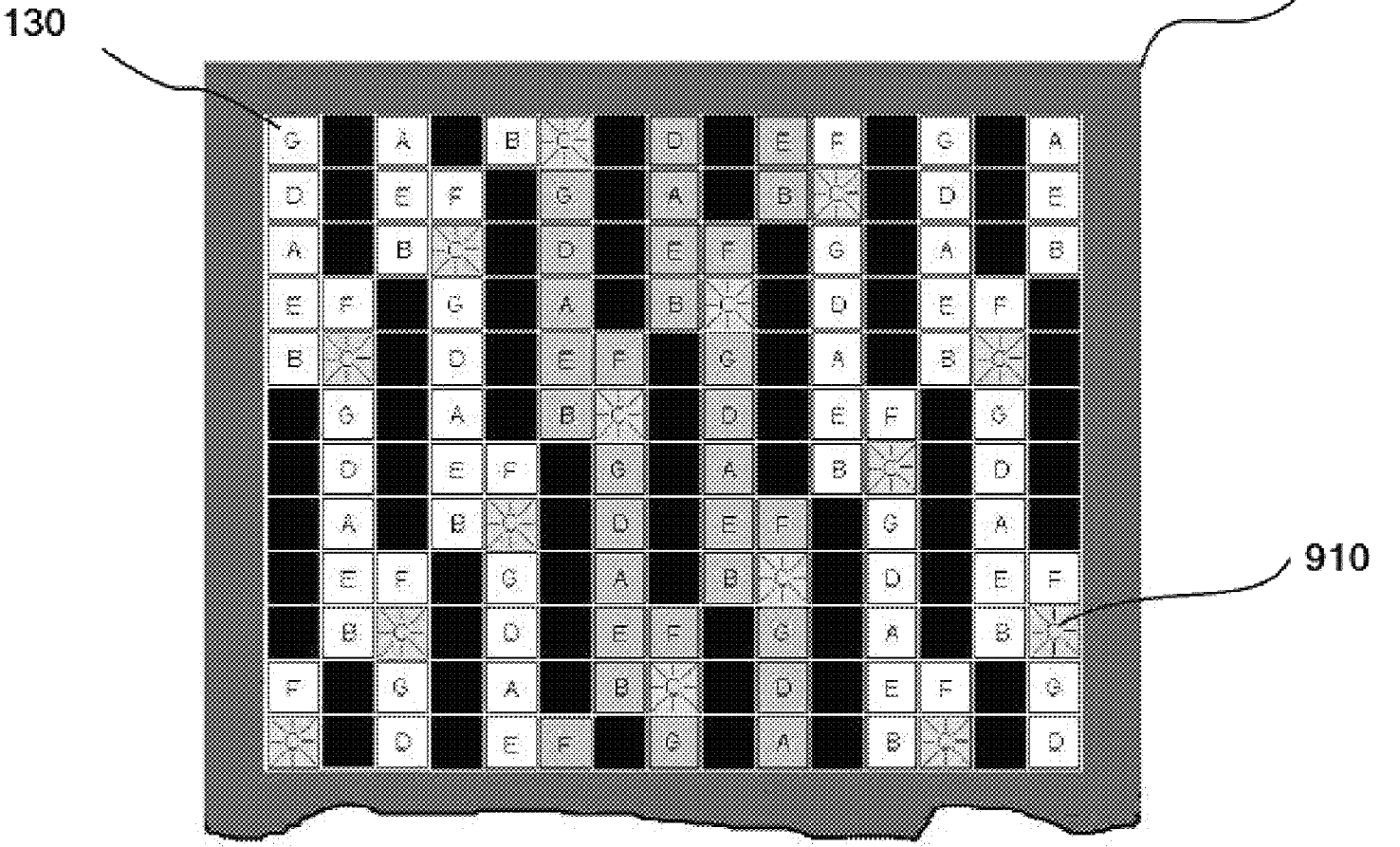
FIG. 9 is a front perspective schematic view illustrating another exemplary embodiment of the present general inventive concept.

Referring to FIG. 9, as an additional aid to orientation, the "C" push buttons 910 are capable of being illuminated. Whatever octave is chosen for the keyboard 100, those push buttons that correspond to Middle "C" in the chosen octave are illuminated.

Figure 5:
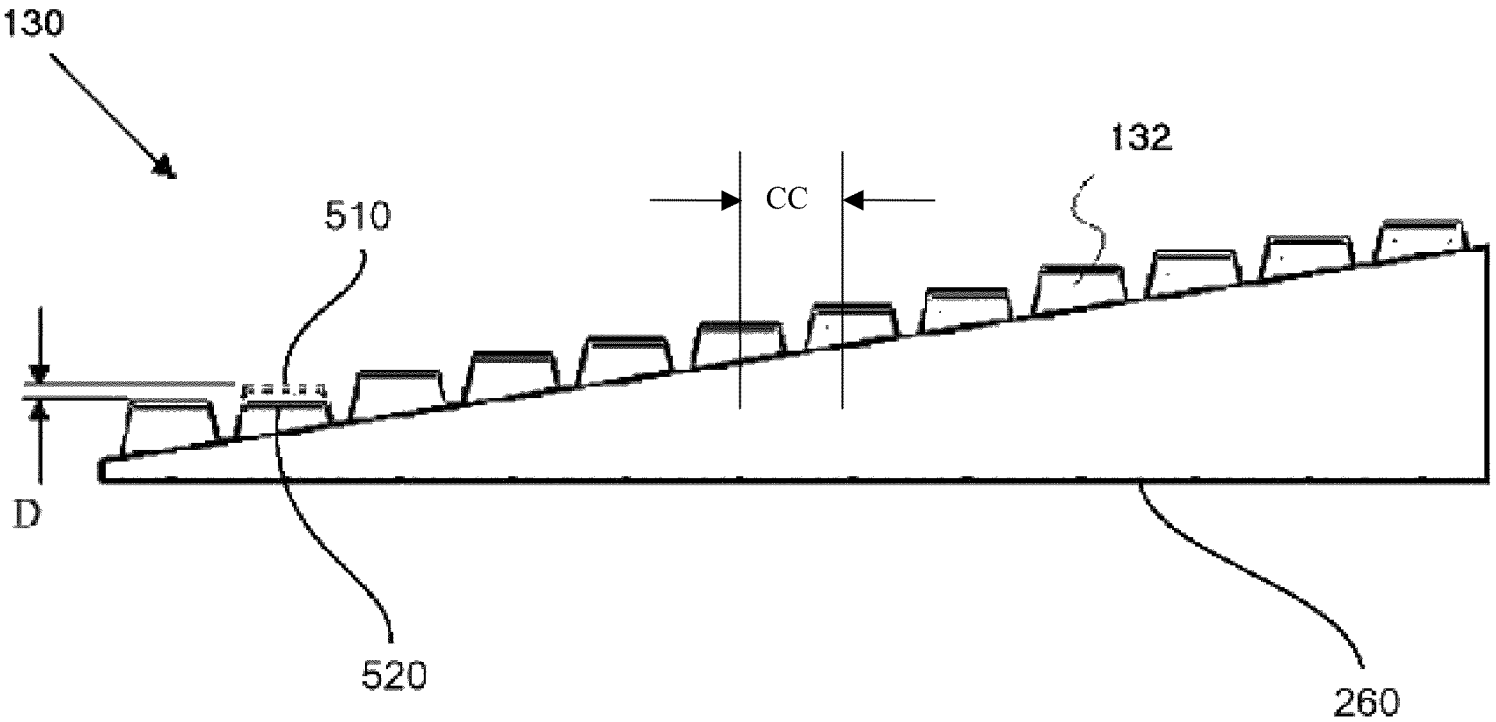
FIG. 5 is a side schematic view of the keypad illustrated in FIG. 4.
Figure 6:
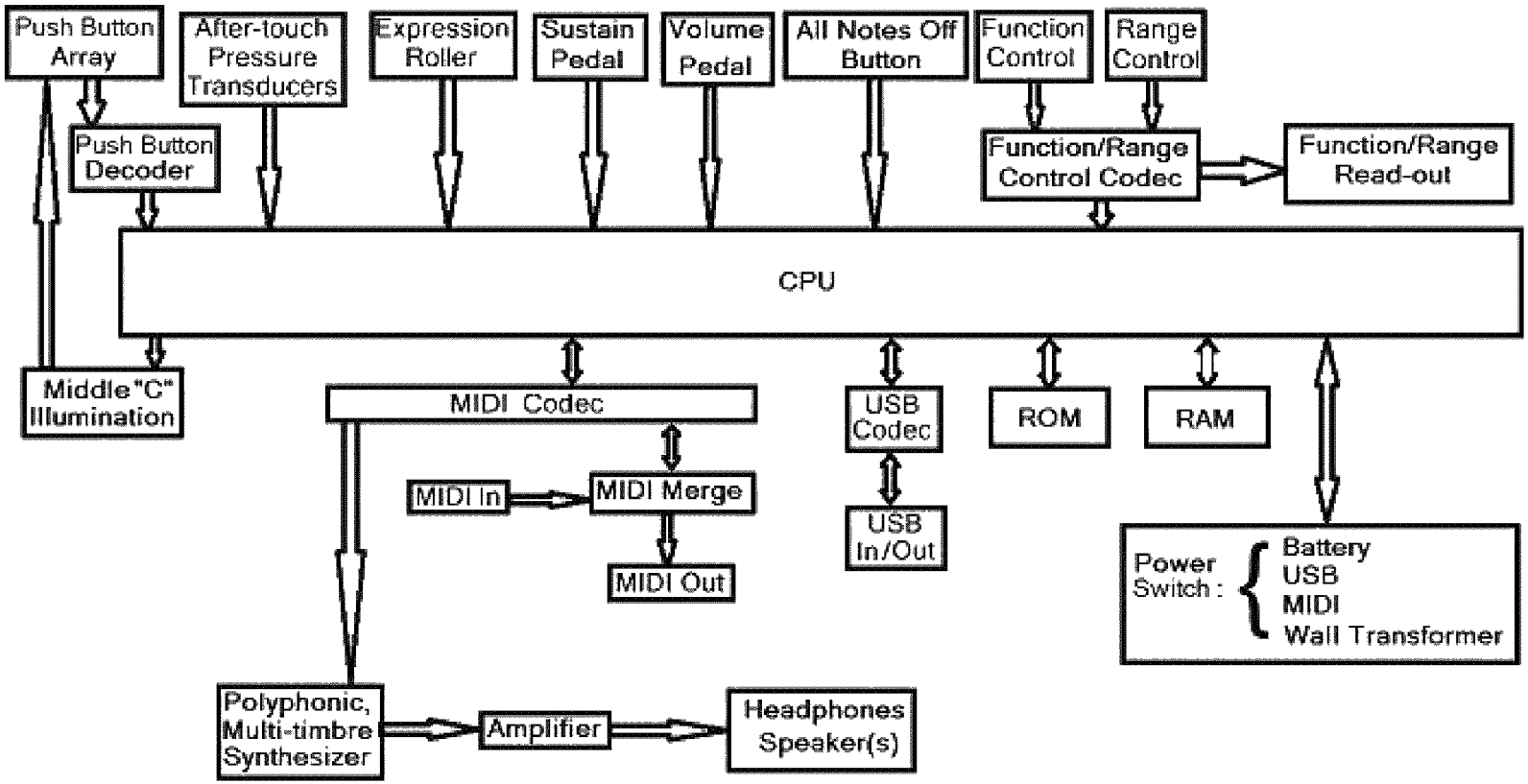
FIG. 6 is a block diagram of the electronics of the MIDI controller keyboard illustrated in FIG. 1, according to an exemplary embodiment.

Referring to FIG. 5, the rows of push buttons 132 are arranged in a tiered structure such that a height of the rows of push buttons "D" increases gradually from the row closest to the player out to the farthest one. As illustrated in FIG. 2, with the hand 210 in a comfortable position, the user's thumb 220 may easily press down any push button 132 without contacting unintended push buttons. Referring to FIG. 5, a clearance distance 'D" between adjacent rows of push buttons is configured to substantially equal the full travel distance 510 to 520 of the push button 132.

In an exemplary embodiment, the velocity feature on the MIDI controller keyboard 100 may be provided in the conventional manner for electronic instruments by using double contact switches. For the measurement of attack velocity the double contact switch includes a first contact which closes immediately when the push button 132 is first pressed (i.e., first position 510) and a second contact which closes when the push button 132 has reached the end of its travel (i.e. the second position 520). For the measurement of release velocity the process is reversed: the first signal is the opening of the contact at the end of travel and the second signal is the opening of the contact at the top of travel. The MIDI controller keyboard 100 may further incorporate software which measures the time lapse between the first and second signals in either case. From this measurement of elapsed time, the software may determine a velocity value and apply this value to the note of the push button 132 as a modification of the sound.

Referring to FIG. 7, the top surface of the push buttons 132 is substantially similar to push buttons of a conventional computer keyboard. Each push button 132 is disposed in a square grid pattern and each push button 132 occupies a square in this grid. The top surface which the finger contacts may be generally square shaped and dished out to form a concave surface conforming to a surface segment of a cylinder with the axis of the cylinder congruent with the longitudinal axis of a user's finger. This results in the raised edges 720, and the front edge 730 of the top surface conforming comfortably to the shape of the user's finger and especially the thumb. The front edge 730 profile is especially beneficial when the player's finger is sliding off of a further push button to press a nearer push button while playing a slurred fourth. The user can judge an up-and-down and side-to-side orientation of the entire keypad 130 based on the form of the push buttons and it provides considerable assistance to the user while gauging moves.

In the present exemplary embodiment, full travel push buttons 132 as illustrated in FIG. 5 are preferred for the keypad 130. On a conventional piano full travel gives tactile feedback which helps further in the orientation of the musician's hands. At the same time, the switches must be completely silent and smooth and not give undesirable feedback by clicking, etc.

The MIDI controller keyboard 100 according to the present general inventive concept utilizes aspects of the musical instrument digital interface ("MIDI") protocol. The electronics for every musical function, MIDI and otherwise, is presented as a block diagram in FIG. 6. The push button array 130 is electrically connected to a push button decoder which outputs signals to a CPU. The after-touch pressure transducers 230, expression roller 190, a sustain pedal, which may be connected to jack 154, a volume pedal, which may be connected to jack 155, and the all-notes-off button 153 likewise output signals to the CPU. The function control 151 and range control 152 send signals to a function/range control codec which in turn outputs signals to both the CPU and a function/range read-out 150.

The CPU sends processed information to the MIDI codec which outputs its information to a polyphonic, multi-timbre synthesizer which outputs to an amplifier which outputs to speakers 120, and to headphones through jack 121 which includes a switch that cuts out the speakers 120 in the event that a set of earphones is plugged into it. The output of the MIDI codec is also sent to the MIDI out jack 122 through a MIDI merge that is also fed with any MIDI signal coming from the MIDI in jack 123. MIDI merge also feeds information back to the MIDI codec and back to the CPU so that the merged signal is available to the USB codec. With a MIDI merge provided in every keyboard, keyboards may be daisy-chained together to provide a single MIDI signal that may be further sent to outboard MIDI equipment through the MIDI out jack 122 and, through the USB out jack 124 to a computer. The CPU likewise communicates with ROM and RAM.

The function control 151, range control 152, codec and read-out 150 are used to control aspects of the keyboard 100 both in the MIDI domain and otherwise. The functions may include volume, instrument sound, attack velocity on-off, release velocity on-off, after-touch on-off, channels, octave, expression roller effect, after touch effect and power source. The all notes-off control 153 may include a momentary push button to be used to turn off notes that are stuck on, which may happen within the MIDI domain. However, the present general inventive concept is not limited to the above-described features.

In exemplary embodiments, the MIDI controller keyboard 100 allows for after-touch, wherein the user is provided a degree of control that may vary a quality of a note or notes after an initial attack or activation. With the development of electronic and MIDI capable instruments, the after touch feature may be applied to any electronic instrument sound, providing novel and varying results. The MIDI controller keypad 130, according to the present general inventive concept, provides a geometry which may readily make use of a novel after-touch system.

Figure 3:
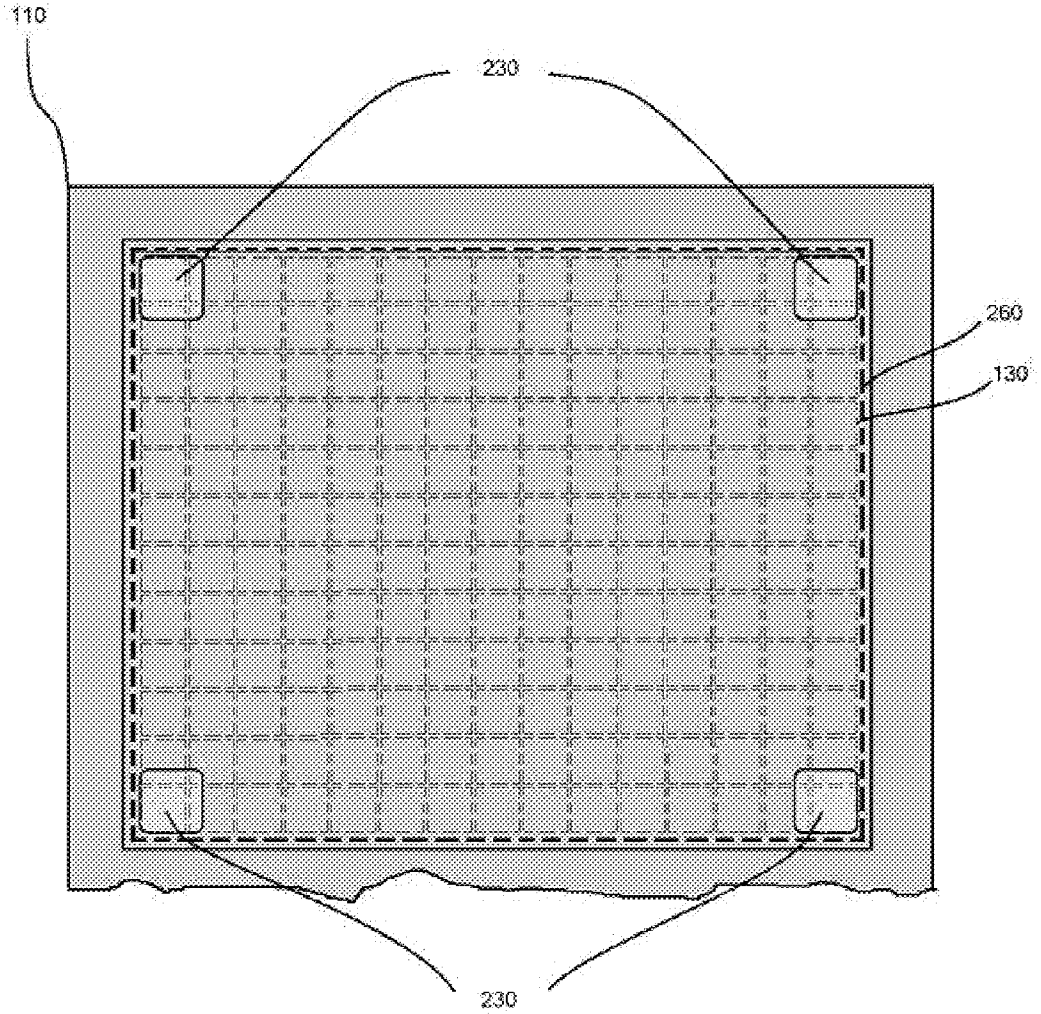
FIG. 3 is a top plan schematic view of a MIDI controller keypad illustrating after-touch effect control according to an exemplary embodiment of the present general inventive concept.

That is, as seen in FIGS. 2 and 3 the MIDI controller keyboard 100 includes an after-touch control system having four pressure transducers 230 which are disposed between the bottom of the rigid substrate 260 of the keypad 130 and the bottom of the housing 110 at the outer four corners of the nearly square profile. A vector of downward pressure applied anywhere on the keypad 130 is distributed among the transducers 230. A summing of the electronic signal emitted by the transducers is proportional to the downward pressure and said signal may be converted to the after-touch signal for a note or set of notes that are being sustained. However, the present general inventive concept is not limited to the above described MIDI features.

On conventional MIDI keyboards, a wheel is a form of MIDI control that may be placed at one end of the keyboard. This control wheel is a type of mechanism which may be used in pitch bending and various other types of tone modulation. However, the wheel placed at the end of the keyboard requires that the user remove his hand from the keyboard, while playing, to activate the wheel. This is an inconvenient arrangement and places an encumbrance on the performer.

In the present exemplary embodiment, the MIDI controller keyboard 100 includes an expression roller 190 that performs the same function as the conventional wheel. The user rotates the expression roller 190 by merely lowering his arm 210 to contact the expression roller 190 with his wrist or forearm, and then moving his arm slightly forward and back while still having his fingers in contact with the plurality of push buttons 132.

In the MIDI protocol there are 16 separate channels through which musical information may be sent. Channel 10 is customarily reserved for percussion information. This leaves 15 channels that may be assigned to other instrument sounds. All the channels can be assigned to the same instrument sound or, alternatively, each channel may be assigned a different instrument sound.

In the present exemplary embodiment, the MIDI controller keyboard 100 is 15 columns wide. Five columns of push buttons 132, corresponding to the five fingers of the hand 210, is are all that are needed to encompass the full chromatic scale and therefore to play any music based upon the chromatic scale. Thus, the MIDI controller keypad 130 may be divided into three five column wide zones (Z1, Z2 and Z3). These three zones may be delineated by different shading or colors of the push buttons 132. Each of these zones is a complete instrument in itself. In the present exemplary embodiment, with "Channels" selected with the function control 151, the channels assigned to Z1, Z2 and Z3 with the range control 152 can be 1, 2, 3; 4.5.6; 7, 8, 9; 11, 12, 13 or 14, 15, 16.

The MIDI controller keyboard 100 may be operated in a plurality of modes. In a first mode, the entire keypad 130 of the MIDI controller keyboard 100 may sound as a single continuous instrument. That is, the three zones (Z1, Z2 and Z3), whatever set of channels they are assigned to, all sound like the same instrument. As a single instrument, the 15 push buttons in each row comprise a continuous chromatic scale. Going from a push button 132 in any row to a push button directly out or back always comprises a perfect fourth. This makes the keypad completely uniform and symmetrical and the zone boundaries can be ignored. A musical piece that was learned starting on any note of the keypad may be played with exactly the same fingering starting on any other note of the keypad.

The assignment of each zone of the keypad 130 to a different channel means that each will have independent tone generation. When the keypad 130 is operated in the first mode as above, independent tone generation for each of the zones provides an additional advantage over conventional keyboards. The tonal relationships of the keyboard provides reduplication of notes. That is the exact same note can be played with different push buttons 132 of the keypad 130. On a conventional piano keyboard a rapid roll on one note requires two fingers (generally two different hands) and the speed is limited by the mechanical action of the keyboard. With the tonal arrangement of the keyboard, two push buttons 132 sounding the same note are an easy reach of two fingers of one hand and a roll on that one note is not only easily accomplished with one hand, but an even more rapid roll can be sounded than on a conventional keyboard. Referring to FIG. 1 using a "G" note as an example, the same sound can be heard with push button 132*a*, 132*c* and 132*d*. Each of these notes is in a different zone and it is the same for every reduplicated note: they are always in different zones. This means that their notes are independently sounded, so that if you press pushbutton 132*a*, for example, and hold that down while pressing pushbutton 132*c*, there will be a second attack sound, not just a continuation of the note. This is essential for the musical expression of a roll on a note.

In a second mode, the three zones (Z1, Z2 and Z3), of the keypad 130, being assigned to a different channel each, may have a different instrument sound chosen for each. In exemplary embodiments, as many as 15 different instrument sounds may be pre-assigned to the 15 MIDI channels reserved for tonal instruments. The various instruments can then be quickly called up, three at a time, by utilizing the function control 151 and the range control 152.

Figure 10:
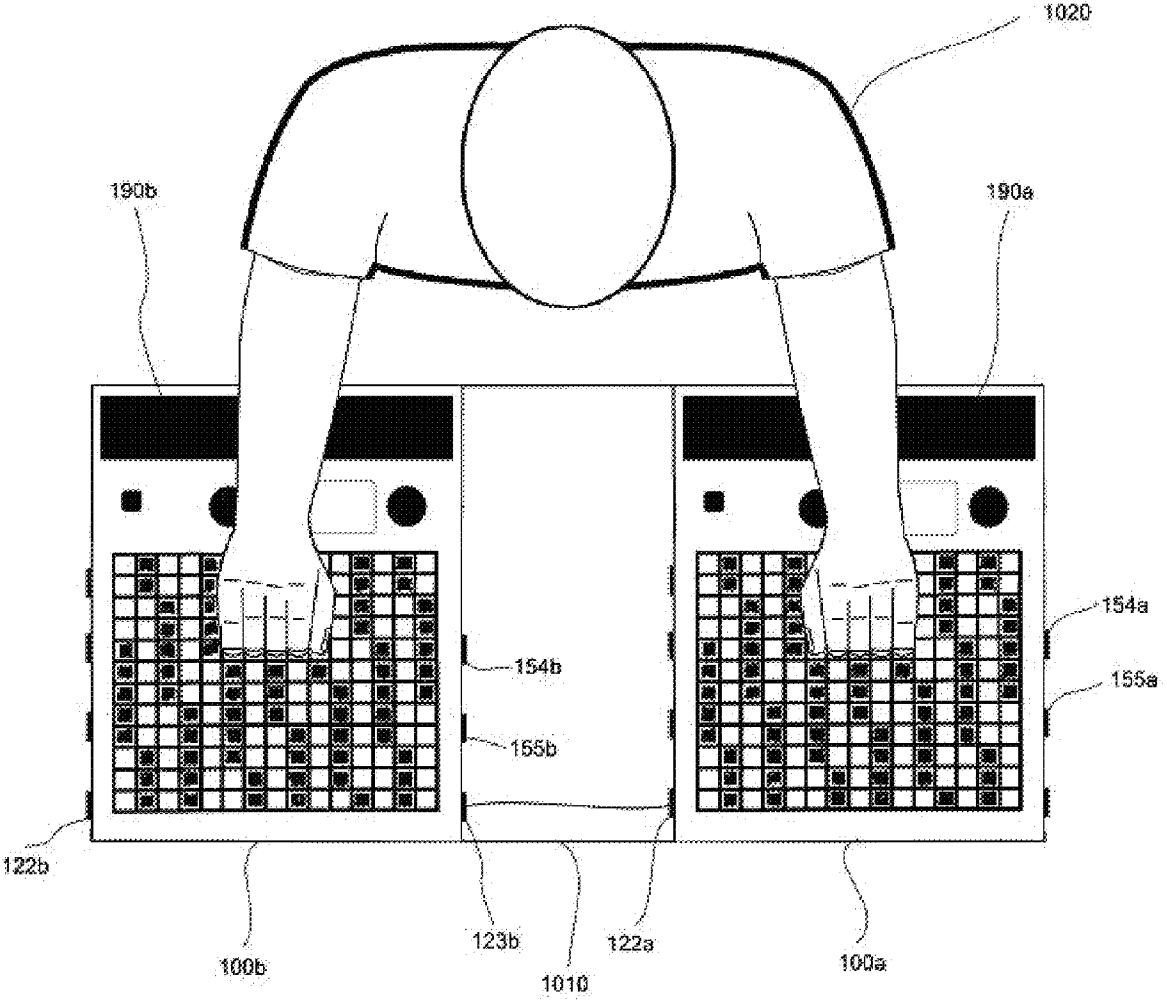
FIG. 10 is a top plan schematic view illustrating a user operating a MIDI controller keyboard system comprising two MIDI controller keyboards coupled together according to another exemplary embodiment of the present general inventive concept.

FIG. 10 is a top plan schematic view illustrating a user 1020 operating a MIDI controller keyboard system 1010 comprising two MIDI controller keyboards 100*a, b* coupled together according to an exemplary embodiment of the present general inventive concept.

The MIDI controller keyboards 100*a, b* may be coupled together by connecting the MIDI-out jack 122*a* of a first MIDI controller keyboard 100*a* to the MIDI-in jack 123*b* of a second MIDI controller keyboard 100*b*. When using two separate MIDI controller keyboards 100*a, b* coupled together, each MIDI controller keyboard 100 may include separate expression rollers 190*a, b*, sustain pedals (not illustrated) plugged into the sustain jacks 154*a, b*, and volume controls (not illustrated) plugged into the volume jacks 155*a, b*. The MIDI-out jack 122*b* of the second MIDI controller keyboard 100*b* then carries the MIDI signals of both the first and second MIDI controller keyboards 100*a, b* which may be routed further to auxiliary MIDI equipment (not illustrated).

As illustrated in FIG. 10, the MIDI controller keyboards 100*a, b* may be arranged adjacent to each other, similar to a configuration of a conventional piano, at convenient angles and separation for the comfort of the user 1020.

Figure 11:
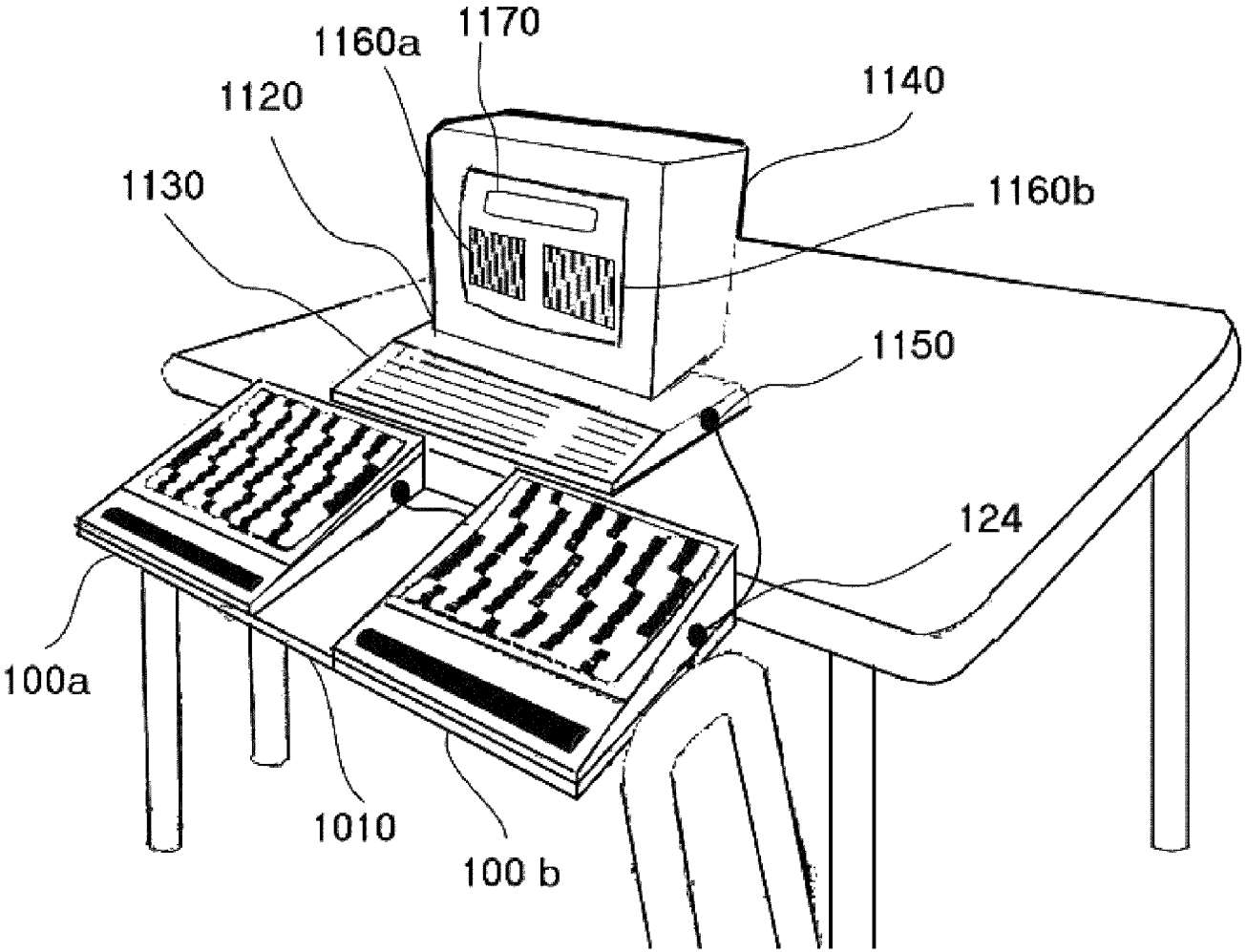
FIG. 11 is a front perspective view of the MIDI controller keyboard system illustrated in FIG. 10 connected to a computer system displaying a tutorial arrangement according to another exemplary embodiment of the present general inventive concept.

FIG. 11 is a front perspective view of the MIDI controller keyboard system 1010, illustrated in FIG. 10, connected to a computer and display monitor showing a tutorial function according to another exemplary embodiment of the present general inventive concept.

The present general inventive concept further includes a tutorial function of the MIDI controller keyboard 100, which may be implemented as a software product in a computer system 1120. In alternative exemplary embodiments, the tutorial function may be integrated within the MIDI controller keyboard 100.

Referring to FIG. 11, the MIDI controller keyboard system 1010 is coupled to the computer system 1120 having the tutorial function stored thereon. The computer system 1120 includes a central processing unit (CPU), one or more input devices (e.g., a mouse, a keyboard 1130, etc.), and one or more output devices (e.g., a display device 1140, a speaker, etc.). The computer system 1120 may further include a storage device coupled to the CPU. For instance, the storage device may include a disk drive, optical storage devices, solid-state storage devices such as random access memory (RAM) and/or a read-only memory (ROM), which can be programmable, flash-updateable, and/or the like.

In exemplary embodiments, the computer system 1120 may further include a computer-readable storage media reader. As described above, the tutorial function, according to the present general inventive concept may be implemented as a software product and/or as instructions causing the computer system 1120 to perform certain functions and operations.

In an exemplary embodiment, various functions of the tutorial function are implemented as software code which is loaded onto the storage device of the computer system 1120. The tutorial function is a means for providing instruction to a user on using a MIDI controller keyboard 100 and/or system 1010.

As described above, the MIDI controller keyboard system 1010 comprises two or more MIDI controller keyboards 100 coupled together as illustrated in FIG. 10. In the present exemplary embodiment, the MIDI controller keyboards 100*a, b*, are coupled together by connecting the MIDI-out jack 122*a* of a first MIDI controller keyboard 100*a* to the MIDI-in port jack 123*b* of a second MIDI controller keyboard 100*b*. The MIDI signals of both the first and second MIDI controller keyboards may then be routed through the MIDI codec, CPU and USB codec and may then be transmitted to the computer system 1120 through the USB out jack 124 connected to a USB port 1150 of the computer system 1120. The tutorial function represented by software code may further include a means for providing tone generation for the MIDI controller keyboard system 1010, substantially similar to conventionally known tone generators.

The computer system 1120 may be coupled to an external network in order to receive MIDI music files. As the MIDI music files are downloaded, each one may be assigned a slot in memory that links it with a push button so that it may be instantly recalled. The music files may be ordered alphabetically initially. In the present exemplary embodiment, there are 180 (15×12) pushbuttons 132 per keypad 130. Two keyboards provides 360 push buttons in total. As a button is pushed in the "Select Song" mode, the title of the musical piece appears on the read-out portion 1170 of the display device 1140. The push buttons 132 may be ordered numerically so that there is a number one position. If a selected musical piece is listened to or started in the "Learn" mode it moves into position "One" on, say, the left hand keypad 130*a*. That puts it as a musical piece of interest, in a defined and readily accessible location. All of the other files are shifted down one location, and so on. There is room in memory for more than 360 MIDI files. Any file beyond 360 can be called by shifting further banks of 360 files into keyboards 100*a, b* push button 132 positions. The MIDI file format provides several further advantages over other music file formats in that MIDI files are most compact in file size and also provide the ability to separately treat each musical instrument within the music, so that each instrument may be played independently, if desired. The tutorial function uses this advantage of MIDI files and allows the user to specify which instrument within the MIDI file to learn.

The tutorial function may play a selected MIDI file to allow the user to hear the contained music. The tutorial function may then allow the user to isolate and play only a single instrument within the MIDI file. The tutorial function may output a signal to the display device 1140 to display images 1160*a, b* representing the first and second keyboards 100*a*, 100*b*. While a MIDI file plays, the tutorial function indicates on the displayed images 1160*a, b* which notes are being played, by changing a color of the representation of the played push button 132. Similarly, when the user plays a push button 132 on a keyboard 100, that push button 132 is indicated on the display device 1140, by changing a color of the representation of that displayed push button 132. If the MIDI music file contains song lyrics, the lyrics will be displayed karaoke style in the read-out portion 1170 of the display device 1140 screen.

In an exemplary embodiment, for a user (i.e., a musician) to learn a selection of music using the tutorial function, he/she enters the "Learn" mode of the software code and selects which instrument to learn. The tutorial function then plays the MIDI music file (with all of the accompaniment sounding if desired and lyrics, if any) up to the first note of the instrument selected. This note is then indicated on the display device 1140, but is not sounded until the user presses the corresponding push button on the appropriate keyboard 100*a*, 100*b*. However, if the user presses the wrong push button 132, the incorrect note would be displayed in a distinctive color on the display device 1140, but would not be sounded. That is, in learn mode, only the correct push button indicated on the display device 1140 would sound when pressed by the user. Once the user presses the indicated note correctly, the music proceeds to the next note of the selected instrument and the process repeats until all notes of the selected instrument have been played.

Having the first and second keyboard images 1160*a, b* displayed on the display device 1140 allows the user to easily see which push buttons 132 have been indicated, rather than lighting up the physical keyboard as in some conventional keyboards. In the present exemplary embodiment, the display device 1140 is never obscured by the user's hands and therefore provides a clear line of sight of indicated notes to the user.

A feature of a MIDI music file is that it includes an indication of the key of a piece of music. With this information, the tutorial program, in the "Learn" mode may indicate on the keyboard representations 1160*a, b* the preferred placement of the hands for that key. A consistent regime for the placement of the hands respective of the key is a further learning aid. For instance, if the music is in the key of "C", the hands may be positioned so that the left hand pinky is in the column where "C" is on keyboard 100*a* and the right hand thumb is likewise in the column where "C" is on keyboard 100*b*. This indication may be accomplished on the display 1160*a, b* with two sets of vertical lines delimiting the preferred 5-column wide playing area on each keyboard 100*a,b*, but any other indication may be useful. With this additional advantage of each finger being assigned to a column of push buttons 132 at the beginning, there is never any doubt about which finger to use for a specified note. As a result, the problem of finger positioning as with a conventional keyboard is eliminated. With each practice run-through of a musical piece, the same fingers are used for the same notes. This makes the learning process much quicker and quite effortless using the keyboards 100*a*, 100*b* according to the present general inventive concept. In alternative exemplary embodiments, tutorial function may further include additional features which assist the user to learn to play music.

Figure 12:
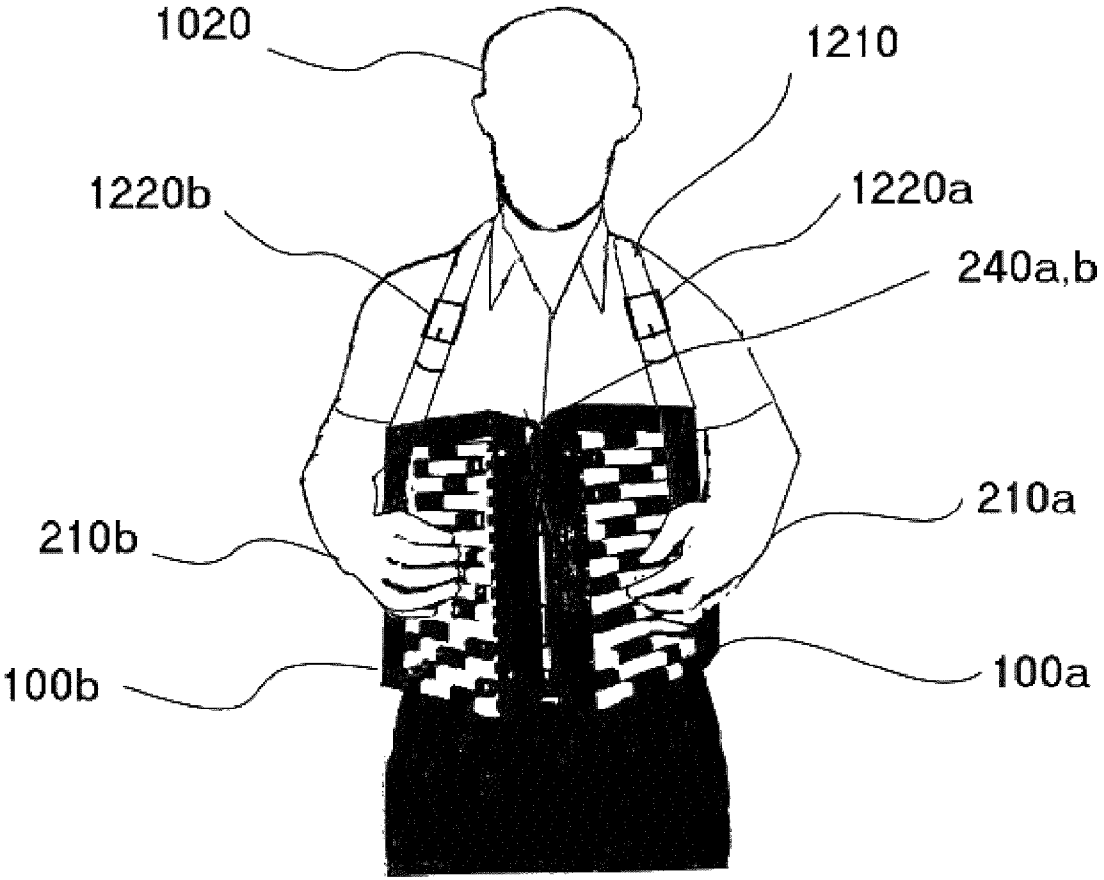
FIG. 12 is a front perspective view of the MIDI controller keyboard system illustrated in FIG. 10 coupled to an accordion-like harness according to another exemplary embodiment of the present general inventive concept.
Figure 13:
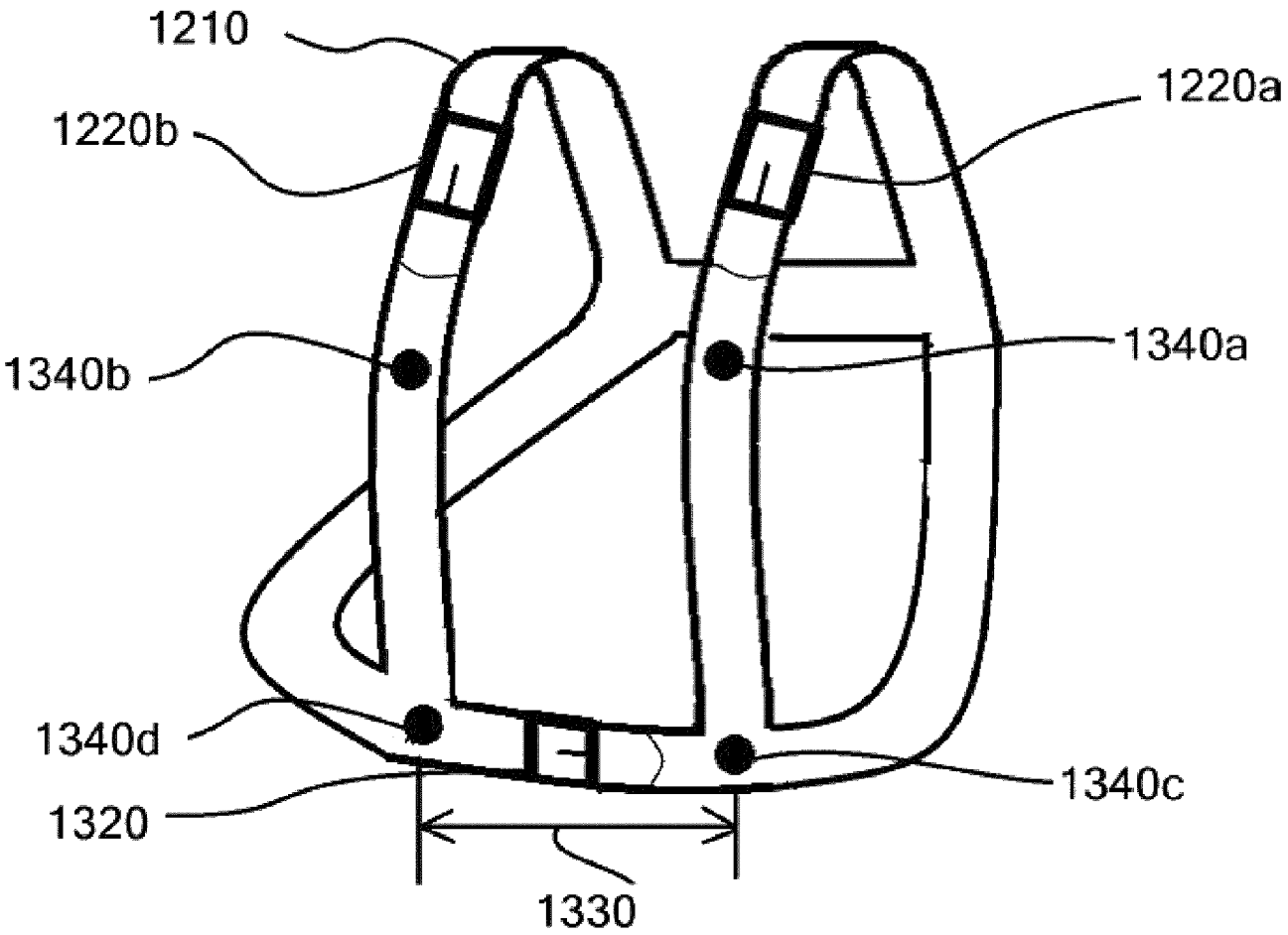
FIG. 13 is a front perspective view of the accordion-like harness illustrated in FIG. 12.

FIG. 12 is a front perspective view of the MIDI controller keyboard system 100*a, b* illustrated in FIG. 10 coupled to an accordion-like harness 1210 according to another exemplary embodiment of the present general inventive concept. FIG. 13 is a front perspective view of the accordion-like harness 1210 illustrated in FIG. 12.

Referring to FIGS. 12 and 13, MIDI controller keyboard system includes a first and second keyboard 100*a*, 100*b* coupled to an accordion-type harness 1210. The user may play the MIDI controller keyboard system while standing upright or seated, similar to the usage of a conventional accordion. The harness 2010 includes a plurality of attachment fittings 1340*a, b, c, d* that mate with fittings on the keyboards 100*a, b* and secure them to the harness 2010. The mating hinges 240*a, b* make the first and second keyboards 100*a*, 100*b* adjustable with respect to each other. In addition, the harness 1210 includes an adjustable fastener 1320 such as a buckle which may be used to control an angle between the keyboards 100*a*, 100*b*. For instance, the user may adjust a front buckle 1320 on the harness 1210 to control a distance 1330 between the backs of the keyboards 100*a*, 100*b* and thus the angle between them. Also, the user may adjust the shoulder buckles 1220*a, b* on the harness 1210 to control a height of the keyboards 100*a*, 100*b* with respect to the user 1020. This configuration allows the user to have considerable freedom of movement while providing for comfortable play.

The positioning of the user's hands 210*a* and 210*b* relative to the keyboards 100*a*, 100*b* is substantially similar to that of a user using the MIDI controller keyboard system 1010, as described above. That is, there is no difference as far as the movement of the fingers is concerned when playing a learned piece of music. Besides that, the present exemplary embodiment provides for an even more ergonomic positioning of the user's hands 210*a, b* relative to his/her forearms.

The MIDI controller keyboard system provides significant other advantages over conventional accordions. In particular, the keyboards 100*a*, 100*b* consists primarily of push buttons 132, electronics, and a lightweight housing which are considerably lighter in weight when compared to a conventional accordion. In an alternative exemplary embodiment, the weight of the MIDI controller keyboard system may be further minimized by using an external tone generator which is wired to the keyboards 100*a*, 100*b* or is coupled thereto using a wireless transmitter. If a wireless transmitter is utilized, a small battery may also be incorporated within the keyboards 100*a*, 100*b*. Even if the keyboards are made as totally self contained musical instruments with speakers and battery operated tone generators, and amplifiers, they still afford a considerable weight advantage over the conventional accordion.

Additional benefits, e.g., ease of play, are achieved by the smaller size of the present keyboards 100*a*, 100*b* when compared with the conventional accordion. At the same time the keyboards 100*a*, 100*b* provide additional octaves of playing range. Also, all of the benefits of the MIDI features described above and of having the two keyboards 100*a, b* with independent controls like expression rollers 190*a, b*, sustain, volume and after touch.

Figure 14:
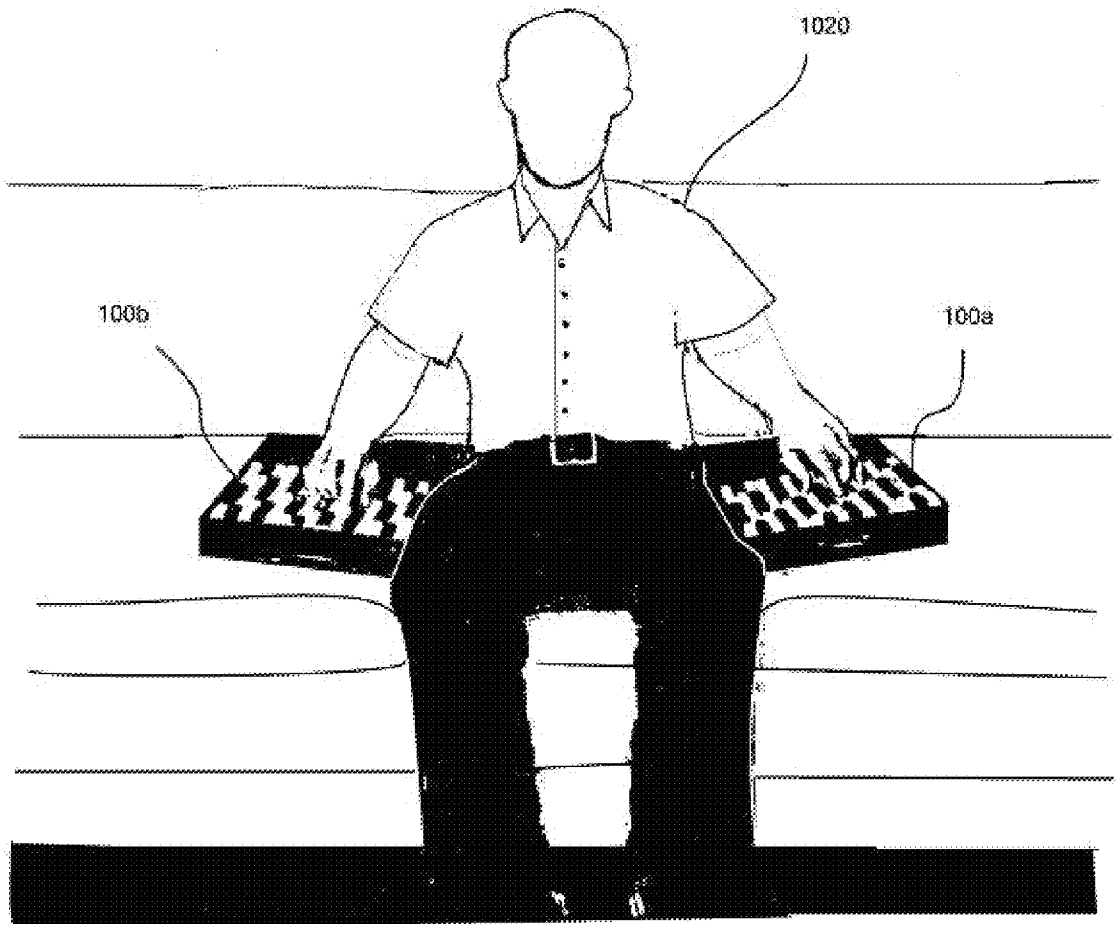
FIG. 14 is a top plan schematic view illustrating a user operating a MIDI controller keyboard system comprising two separate MIDI controller keyboards according to another exemplary embodiment of the present general inventive concept.

FIG. 14 is a top plan schematic view illustrating a user operating a MIDI controller keyboard system comprising two separate MIDI controller keyboards 100*a, b* according to another exemplary embodiment of the present general inventive concept.

Referring to FIG. 14, the MIDI controller keyboard system includes two separate MIDI controller keyboards 100*a* and 100*b* which are placed on either side of a user. In the present exemplary embodiment, the MIDI controller keyboards 100*a* and 100*b* are independently placed in the most convenient positions for ease of play. This arrangement is especially suited to a person who has the use of his arms and fingers but may be otherwise disabled.

Figure 15:
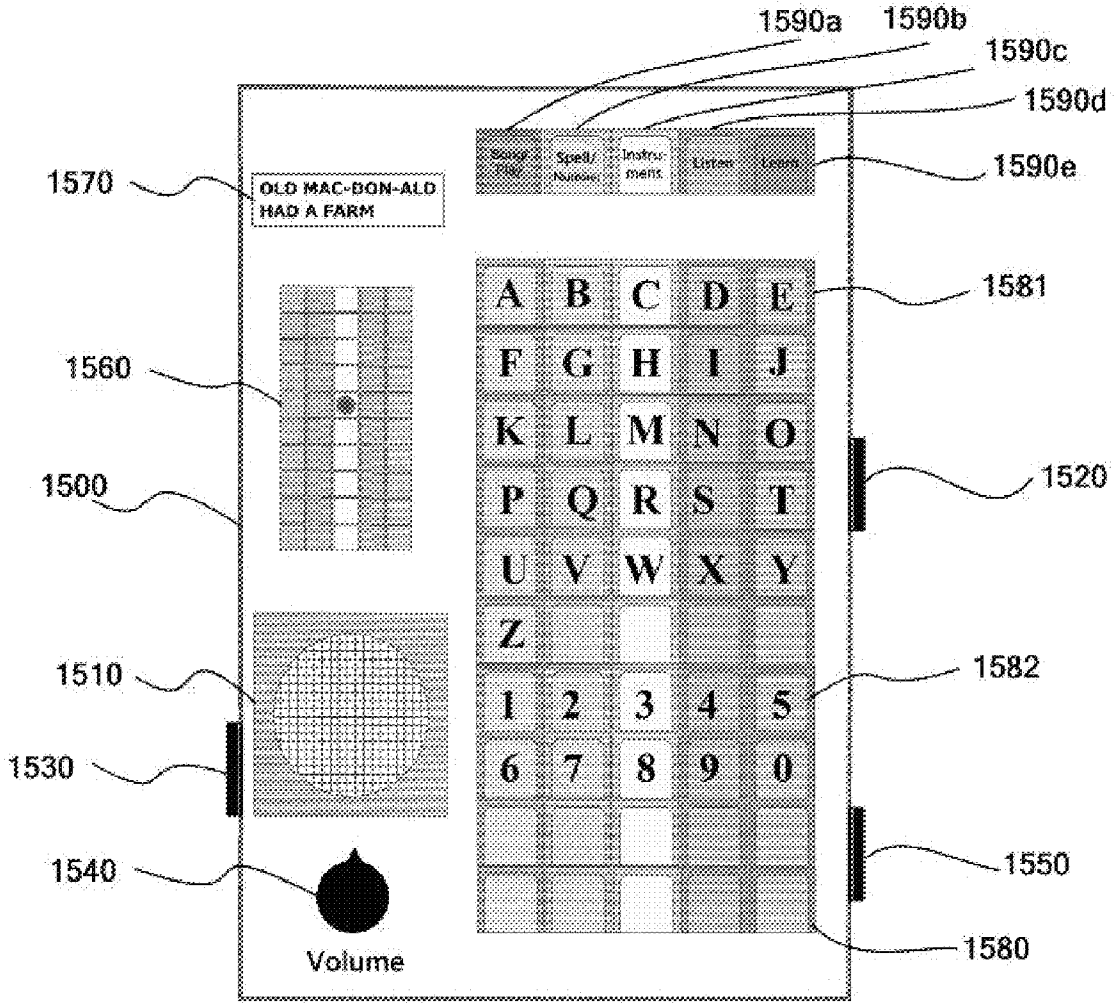
FIG. 15 is a top plan schematic view of a MIDI controller keyboard according to another exemplary embodiment of the present general inventive concept.

In FIG. 15 an embodiment of the keyboard 1500 provides a minimized 5 column wide, self-contained instrument. This embodiment may be suitable as a toy or as a portable practice instrument. The present exemplary embodiment comprises all of the mechanisms, electronics and software to result in a complete, sound producing musical instrument including a polyphonic, multi-timbre tone generator, amplifier and speaker 1510. However, the present general inventive concept is not limited thereto. That is, the MIDI controller keyboard 1500 is integrally formed with all components necessary to function as the previously described embodiments. This embodiment can also be coupled to a computer system by means of the USB jack 1520 to receive musical pieces (e.g., MIDI files), as desired.

The present general inventive concept may also include a standard headphone jack 1530 which includes a switch that cuts out the speaker 1510 in the event that a set of earphones is plugged into it. The volume control 1540 is utilized to set the playback level that is heard from the speaker 1510 or from a set of earphones plugged into the earphone jack 1530. The MIDI controller keyboard 1500 may be powered by batteries or from a wall power unit plugged into the power jack 1550. While the keyboard is powered by batteries it powers off after a time span typically of ten minutes after the last push button is pressed. It will power on again with the press of any push button.

The present general inventive concept also comprises a system that may include the use of computer software. As part of the present invention, custom software is envisioned both to accomplish the downloading of MIDI files from a computer to the present embodiment of the invention and to put those files in any desired order in the keyboard itself, by means of a memory storage device. In order to make it a learning instrument, the present embodiment has an integral keyboard display screen 1560 and an alpha-numeric read-out 1570 as additional features.

The keypad itself may be divided into the playing surface 1580 and a few control push buttons 1590*a, b, c, d, e*. Each column of push buttons may be coded with a different color on the playing surface 1580 and this is matched in the keyboard display 1560. This is to indicate that each of the five fingers normally plays in its own column. The playing surface push buttons may have both the alphabet letters 1581 and numerals 1582 printed, molded in, or inlayed. Control push buttons 1590*a* through 1590*e* may be labeled "Song/Play", "Spell/Number", "Instrument", "Listen" and "Learn" respectively.

The "Song/Play" push button 1590*a* may have a dual role. With one push a song can be called up from the library of MIDI files using any of the push buttons of the playing surface 1580. With the second push the playing surface functions as the push buttons of the instrument and the musician can play anything at will. There are fifty playing surface push buttons, so in the "Song" mode one of fifty musical pieces can immediately be called up by pressing one of the fifty push buttons 1580. As each push button is pressed the title of the song appears on the alpha-numeric display 1560. There is much more room in the memory for storage beyond fifty songs. Others can be called up by pressing the second control push button "Spell/Number" 1590*b* and either spelling out the title of the song on push buttons 1581 or entering a number on the push buttons 1582 to access its storage slot.

Until other musical pieces are downloaded, the order of all of the pieces within its memory preferably remains the same. However when a specific piece is called up by use of the "Song/Play" 1590*a* or "Spell/Number" 1590*b* push buttons and either the "Listen" 1590*d* or the "Learn" 1590*e* push buttons are pressed, that musical piece is placed in the "A" push button position and the other forty-nine pieces are shifted down one push button. So, the piece of present interest is in a position of defined and easy access and remains there until another musical piece is listened to or learned and displaces it from the "A" position to the "B" position, and so on.

The function of the "Listen" push button 1590*d* is just that, to start the playback of the selected piece. The "Learn" push button 1590*e* puts the keyboard in the mode of the tutorial as explained above in the description of FIG. 11. In the "Listen" or "Learn" function the alpha-numeric readout 1560 will display the lyrics to a song karaoke style, if such lyrics are included in the MIDI file.

The "Instrument" control push button 1590*c* has two functions depending upon whether the keyboard is in the "Play" or "Learn" mode. When in the "Play" mode and the musician is playing his own music, he can choose what instrument sound he would prefer. In the "Learn" mode the musician can select the instrument in the chosen musical piece that he wishes to learn. In these cases, the instrument is selected by number, that is, by entering a number using the numeric pad section 1582. As a number is entered, the name of the instrument will appear in the alpha-numeric read-out 1560.

In the MIDI protocol there are 128 basic instrument sounds. Most of these are tonal in character and are suitable for play on an instrument such as the present invention that is basically an instrument that utilizes the standard chromatic scale. In a MIDI music file each instrument in the presentation can be separately called up and therefore can be singled out for learning.

The keypad itself 1500 of this embodiment of the present invention may comprise a substantially similar same height as the keypad in the full sized keyboard 100, that is, twelve rows in height. One row is skipped at the top to separate the playing surface 1580 from the control push buttons 1590, but the underlying construction is the same. This makes for economy in the manufacture of both versions. The full sized keyboard can be constructed by ganging together the basic five-by-twelve sections and decoding the sections for a coordinated output.

Therefore, an advantage of the present general inventive concept over conventional keyboards, is ease of play. This makes the present general inventive concept an easy to learn, easy to play, viable professional musical instrument. As noted, another feature of the present general inventive concept is the mechanism for incorporating "after touch". Because of the nearly square outline of the keyboard, as opposed to the extended linear expanse of a conventional keyboard, a global pressure transducer array can be efficiently used for determining the pressure on the push buttons after they are initially struck, as detailed in FIGS. 2 and 3.

The present general inventive concept can also be embodied as computer-readable codes on a computer-readable medium. The computer-readable medium can include a computer-readable recording medium and a computer-readable transmission medium. The computer-readable recording medium is any data storage device that can store data as a program which can be thereafter read by a computer system. Examples of the computer-readable recording medium include read-only memory (ROM), random-access memory (RAM), CD-ROMs, DVDs, magnetic tapes, floppy disks, and optical data storage devices. The computer-readable recording medium can also be distributed over network coupled computer systems so that the computer-readable code is stored and executed in a distributed fashion. The computer-readable transmission medium can transmit carrier waves or signals (e.g., wired or wireless data transmission through the Internet).

It is to be understood that the foregoing illustrative exemplary embodiments have been provided merely for the purpose of explanation and are in no way to be construed as limiting of the present general inventive concept. Words used herein are words of description and illustration, rather than words of limitation. In addition, the advantages and objectives described herein may not be realized by each and every exemplary embodiment practicing the present general inventive concept. Further, although the present general inventive concept has been described herein with reference to particular structure, steps and/or exemplary embodiments, the present general inventive concept is not intended to be limited to the particulars disclosed herein. Rather, the present general inventive concept extends to all functionally equivalent structures, methods and uses, such as are within the scope of the appended claims. Those skilled in the art, having the benefit of the teachings of this specification, may affect numerous modifications thereto and changes may be made without departing from the scope and spirit of the present general inventive concept.

What is claimed is:

1. A musical instrument comprising:

a housing;

a keypad having a plurality of push buttons arranged in a three-dimensional array of horizontal rows and vertical columns disposed within the housing;

a double contact switch in each push button to generate a first signal when a push button is at one position and a second signal when the push button arrives at a second position;

a plurality of pressure transducers disposed between the housing and the keypad and coupled to the plurality of push buttons; and a CPU with MIDI and USB processing coupled to the keypad to manipulate and control a sound generated with signals from the plurality of push buttons, wherein the horizontal rows of push buttons are arranged in tiers and signals of the pressure transducers are summed to produce a resultant signal proportional to an over-all pressure on the keypad.

2. The musical instrument of claim 1, wherein each push button is movable between the first position and the second position to produce note-on, attack velocity, note-off and release velocity signals.

3. The musical instrument of claim 1, wherein the CPU interprets the resultant signal from the plurality of the pressure transducers and converts that signal into an after-touch value.

4. The musical instrument of claim 3, wherein the after-touch signal controls a quality of the sound produced by the plurality of push buttons.

5. The musical instrument of claim 2, wherein the CPU determines velocity values based on a calculated time between receiving the first signal and the second signal.

6. The musical instrument of claim 5, wherein the velocity values control a quality of the produced sound.

7. The musical instrument of claim 1, wherein the CPU allows for multiple push buttons to generate a polyphony sound.

8. A musical instrument comprising:

a housing;

a keypad having a plurality of push buttons arranged in a three-dimensional array of horizontal rows and vertical columns disposed within the housing;

a double contact switch in each push button to generate a first signal when a push button is at one position and a second signal when the push button arrives at a second position; and a CPU with MIDI and USB processing coupled to the keypad to manipulate and control a sound generated with signals from the plurality of push buttons, wherein the horizontal rows of push buttons are arranged in tiers and a clearance distance between adjacent rows of push buttons equals a distance a push button travels from the first position to the second position.

9. A musical instrument comprising:

a housing;

a keypad having a plurality of push buttons arranged in a two-dimensional array of horizontal rows along a first direction and vertical columns along a second direction, disposed within the housing;

a double contact switch in each push button to generate a first signal when a push button is at one position and a second signal when the push button arrives at a second position; and a CPU coupled to the keypad to manipulate and control a sound generated with signals received from the plurality of push buttons, wherein the horizontal rows of push buttons are arranged in tiers along a third direction and a clearance distance between adjacent rows of push buttons equals a distance a push button travels from the first position to the second position.

10. The musical instrument of claim 9, wherein the first, second, and third directions are substantially perpendicular to each other.

11. The musical instrument of claim 10, wherein the two-dimensional array includes twelve rows and fifteen columns of push buttons.

12. The musical instrument of claim 9, wherein a center-to-center distance of adjacent push buttons is about half an inch to about one inch apart.

13. A non-transitory storage medium having stored thereon a computer program comprising computer code for executing a method for generating, when the computer program is executed on a processor coupled to a musical instrument comprising a housing, a keypad having a plurality of push buttons arranged in a three-dimensional array of horizontal rows and vertical columns disposed within the housing, and a CPU with MIDI and USB processing coupled to the keypad to manipulate and control the sound generated with signals from the plurality of push buttons, wherein the horizontal rows of push buttons are arranged in tiers, an audio signal and a display signal upon a manual input, the method including:

receiving a MIDI music file;

receiving an input signal defining an instrument to use within the received MIDI music file;

outputting a display signal to a display device representing an image of the defined instrument;

outputting an illuminate signal to illuminate notes on the keypad and the image displayed on the display device corresponding to notes within the received MIDI music file; and outputting an audio signal to an audio device when an illuminated note is pressed, wherein the audio signal produces a sound corresponding to the illuminated note.

14. The method of claim 13, wherein the notes within the received a MIDI music file are produced sequentially when the corresponding illuminated note is pressed.

* * * * *